United States Patent [19]

Bordi et al.

[11] Patent Number: 4,754,728

[45] Date of Patent: Jul. 5, 1988

[54] FOUR-VALVE CYLINDER HEAD OF DESMODROMIC OPERATION, FOR INTERNAL COMBUSTION ENGINES

[75] Inventors: Massimo Bordi, San Lazzaro di Savena; Gianluigi Mengoli, Bagnarola, both of Italy

[73] Assignee: Ducati Meccanica S.p.A., Bologna, Italy

[21] Appl. No.: 52,558

[22] Filed: May 19, 1987

[30] Foreign Application Priority Data

Jun. 5, 1986 [IT] Italy ..... 20685 A/86

[51] Int. Cl.[4] ..... F01L 1/30

[52] U.S. Cl. ..... 123/90.26; 123/90.27

[58] Field of Search ..... 123/90.24, 90.26, 90.27

[56] References Cited

U.S. PATENT DOCUMENTS

| | | | |
|---|---|---|---|
| Re. 14,228 | 12/1916 | MacVicar | 123/90.24 |
| 1,544,784 | 7/1925 | Thomas | 123/90.24 |
| 2,751,895 | 6/1956 | Gassmann | 123/90.24 |
| 3,098,472 | 7/1963 | Hoenick | 123/90.24 |
| 3,430,614 | 3/1969 | Meacham | 123/90.24 |
| 4,686,945 | 8/1987 | Inagaki et al. | 123/90.27 X |

FOREIGN PATENT DOCUMENTS

| | | | |
|---|---|---|---|
| 2467971 | 5/1981 | France | 123/90.24 |

*Primary Examiner*—Tony M. Argenbright
*Attorney, Agent, or Firm*—Ladas & Parry

[57] ABSTRACT

A four-valve cylinder head for internal combustion engines, in which the valves are operated desmodromically, each by a pair of rockers, one for closing and the other for opening the respective valve, each rocker being mounted on a separate support pin, and the rockers being controlled by parallel camshafts.

5 Claims, 2 Drawing Sheets

FOUR-VALVE CYLINDER HEAD OF DESMODROMIC OPERATION, FOR INTERNAL COMBUSTION ENGINES

DESCRIPTION

This invention relates to an internal combustion engine cylinder head with four valves per cylinder, of which two are intake valves and two are exhaust valves.

An object of the present invention is to provide a four-valve cylinder head of extremely small dimensions and thus particularly suitable for internal combustion engines for motorcycle use in which such small dimensions are of considerable technical importance.

A further object of the present invention is to provide a four-valve cylinder head for internal combustion engines, in which valve adjustment and access to the adjustment members are considerably facilitated.

A further object of the present invention is to provide a four-valve cylinder head in which the main mechanical machining can be carried out in orthogonal planes, so facilitating, and simplifying head construction.

A further object of the present invention is to provide easy and rapid removal of its component parts.

A further object of the present invention is to provide a four-valve cylinder head for internal combustion engines which is able to be assembled into a complete sub-unit which if required can undergo grinding-in and checking.

These and further objects which will be more apparent from the detailed description given hereinafter are attained by a four-valve cylinder head for internal combustion engines, characterised essentially in that the valves are operated desmodromically, each by a pair of rockers, one for closing and one for opening the respective valve, each rocker being mounted on a separate support pin, and the rockers being controlled by parallel camshafts.

According to an important aspect of the invention, at least the valve opening rockers are mounted on the relative pin in such a manner as to enable them to be moved along the pin axis away from or onto the valve, thus allowing rapid valve adjustment.

The cylinder head comprises covers situated on the sides thereof, to facilitate access to the internal cylinder head members.

The invention will be more apparent from the detailed description of a preferred embodiment thereof given hereinafter by way of non-limiting example and illustrated on the accompanying drawing, in which.

Figure 1:
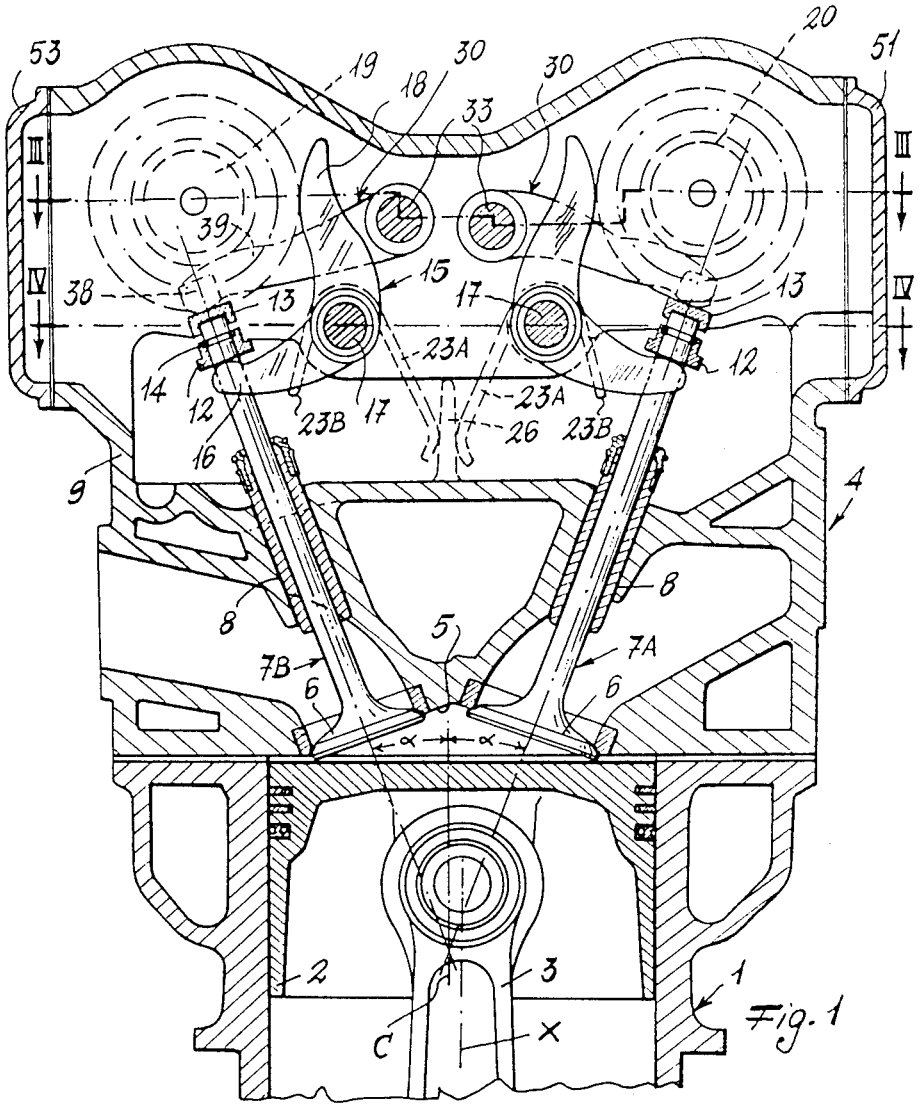
FIG. 1 is a vertical section through the cylinder head, taken on the line I—I of FIG. 2.
Figure 2:
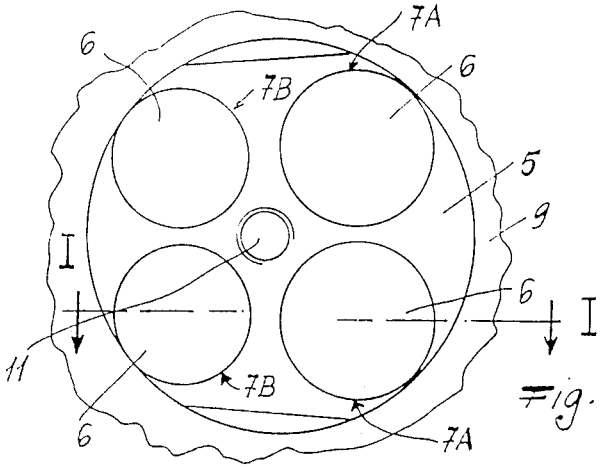
FIG. 2 is a diagrammatic view of the head taken in the direction of the arrow F of FIG. 1.

In the figures, the reference numeral 1 indicates the cylinder of an internal combustion engine, in which a conventional piston 2 connected to a connecting rod 3 is mobile. The cylinder head 4 of the invention is fixed to the cylinder in suitable known manner.

The cylinder head contains the cylinder roof 5 in which are disposed the heads 6 of four valves 7A, 7B, of which two are intake valves (7A) and two are exhaust valves (7B). The stems of the intake valves 7A are parallel, and their axes are inclined at an angle $\alpha$, preferably of 20° to a straight line C parallel to the longitudinal axis X of the cylinder. The same applies to the stems and axes of the exhaust valves 7B, however the straight line is obviously not that indicated by C but another straight line, not shown.

The stems of the valves 7A, 7B are slidingly guided in conventional supports 8 mounted in the cylinder head structure 9.

The hole 11 for the spark plug, not shown, is provided in the centre of the roof 5.

Two registers 12, 13 are mounted on the ends of the valve stems. The register 12 consists substantially of a flanged ring mounted on the stem and locked in one direction by two half rings 14 which are partly inserted into an annular groove in the stem and partly project externally to interfere with an annular internal step on the ring 12. The register 13 consists of a cap mounted over the end of the stem.

Figure 4:
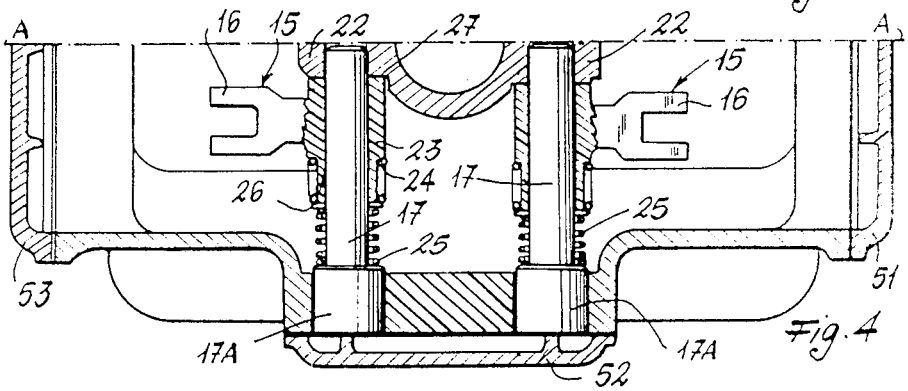
FIG. 4 is a diagrammatic half-section on the line IV—IV of FIG. 1, but with some members omitted and others shown in full view.

A rocker 15 for controlling the closure of the respective valve cooperates with each register 12. This rocker has a fork-shaped end 16 which embraces the stem and acts on the valve by way of the register 12. The four rockers 15 are identical and each of them is mounted rotatable on a separate pin 17 (two such pins are shown in FIG. 4; the other two are located in the cylinder head in a position substantially symmetrical about the line A—A).

The rockers 15 are substantially of L-shape (FIG. 1), and the relative pin 17 is situated at the elbow. The other end 18 of the rockers 15 adheres against the contour of a cam provided on a camshaft 19, 20. The camshaft 19 controls the two exhaust valves 7B, and the camshaft 20 controls the two intake valves 7A.

The four pins 17 each have a head 17A which is centered within a corresponding hole 21 of the cylinder head structure 9 and are also supported at their other end in supports 22 in said structure.

In a depressed part of the hub 23 of the rockers 15 there is disposed a torsion spring 24, the arms 23a and 23B of which act respectively against a counteracting wall 26 of the structure 9 and against the end 16 of the rocker 18 so as to urge the valves 7A, 7B into their closed position.

Compression springs 25 act on the hubs 23 by way of a ring 26. These springs act on the heads 17A of the pins 17 and urge the rockers 15 against ledges 27 provided on the structure 9 in correspondence with the supports 22 for the pins 17.

With each register 13 there cooperates a rocker 30 which controls the opening of the respective valve. Each rocker comprises a hub 31 by which it is rotatably mounted on a corresponding pin 33. The hub, and thus the rocker, is loaded by a compression spring 34 which urges it against a ledge 35 on the cylinder head structure 9 and which acts against the head 33A of the pin 33. The head is centered within holes in the structure 9, and the other end is supported in supports 36 on said structure.

Figure 3:
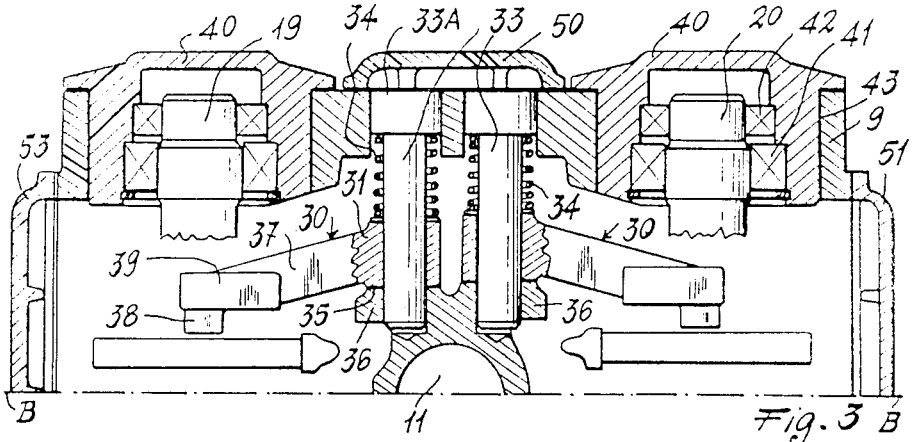
FIG. 3 is a diagrammatic half-section taken on the line III—III of FIG. 1, but with some members omitted and others shown in full view.

The rockers have an inclined arm 37 which is not orthogonal to the axis of the pin 33, this arm terminating with a lateral appendix 38 by which it acts against the register 13, and with a part 39 which is orthogonal to the axis of the pin 33 and against which a cam of the corresponding camshaft 19, 20 acts. The four rockers 30 are identical in pairs. Two of them with their relative pins are shown in FIG. 3. The other two are located in the cylinder head in positions substantially symmetrical with respect to the line B-B.

The shafts 19, 20 are supported at one end in covers 40 provided with conventional bearings 41 and seals 42 and fixed in known manner into holes 43 in the cylinder head structure 9. At the other end, not shown in the figures, support covers are provided, through which however the shafts pass, and on their projecting ends there are fixed for example sprocket wheels for driving the shafts by means of a chain or toothed belt driven by the engine.

When seen in plan view, the cylinder head according to the invention is substantially of quadrilateral shape, and on each of its sides there are provided covers 50, 51, 52 and 53, two of which (50, 52) hide the pins 17, 33 from view, whereas the other two allow access to the registers 12, 13.

For example if it is required to replace the registers 12, 13 of the valve 7A (shown in FIG. 1) by others which are dimensionally more suitable, the cover 51 is removed, the shaft 20 is rotated until the corresponding rocker 30 no longer presses against the stem of the valve 7A, the rocker 30 is moved along the pin 33 against the spring 34 so as to withdraw it from the valve stem, and while keeping it withdrawn the two registers are removed and replaced with others more suitable, after which the rocker is returned onto the valve stem by sliding it along the relative pin 33, and the cover 51 is closed.

If for example this latter rocker 30 is to be replaced, the covers 50, 51 are removed, the pin 33 is withdrawn while holding the rocker 30 and spring 34, and these latter are then removed through the aperture obtained by removing the cover 51. The rockers 15 are removed in a like manner.

Although only one embodiment of the invention has been described, it will be simple for an expert of the art, now in possession of the inventive idea, to make numerous modifications, but which must all lie within the scope of the invention itself.

What is claimed is:

1. A four-valve cylinder head for internal combustion engines, characterized in that the valves are operated positively, each by a pair of rockers, one for closing and the other opening the respective valve, each rocker being mounted on a separate support pin and the rockers being controlled by parallel camshafts, at least the rockers for opening the valves being mounted on the support pins in such a manner as to enable them to be moved along the pin axis away from or onto the valve, the valve opening rockers being moved against the action of a spring mounted on the support pin.

2. A cylinder head as claimed in claim 1, characterised in that the rockers for openin the valves are inclined at other than 90° to the axis of the support pin and comprise at their free end a part which is inclined at 90° to said axis, and a lateral appendix which operates on the valve.

3. A cylinder head as claimed in claim 1, characterised in that the rockers for closing the valves are mounted on the support pins are are loaded by an axial spring and by a torsion spring which keeps the rocker in contact with the camshaft.

4. A cylinder head as claimed in claim 1, characterised in that the valves are inclined at about 20° to a line parallel to the axis of the engine cylinder.

5. A cylinder head as claimed in claim 1, characterised in that the ignition spark plug is located in correspondence with the centre of the cylinder roof.

* * * * *